US006737792B2

(12) United States Patent
Saito et al.

(10) Patent No.: US 6,737,792 B2
(45) Date of Patent: May 18, 2004

(54) FIELD EMISSION CATHODE, ELECTRON EMISSION DEVICE AND ELECTRON EMISSION DEVICE MANUFACTURING METHOD

(75) Inventors: Ichiro Saito, Kanagawa (JP); Kouji Inoue, Kanagawa (JP); Shinichi Tachizono, Chiba (JP); Takeshi Yamagishi, Chiba (JP)

(73) Assignee: Sony Corporation (JP)

( * ) Notice: Subject to any disclaimer, the term of this patent is extended or adjusted under 35 U.S.C. 154(b) by 234 days.

(21) Appl. No.: 09/740,791

(22) Filed: Dec. 21, 2000

(65) Prior Publication Data

US 2001/0005112 A1 Jun. 28, 2001

(30) Foreign Application Priority Data

Dec. 27, 1999 (JP) ..... 11-370360

(51) Int. Cl.[7] ..... H01J 1/30
(52) U.S. Cl. ..... 313/310; 315/169.1
(58) Field of Search ..... 313/310, 311, 313/495, 345, 352, 497, 346 R, 309, 336, 351, 329; 315/169.1, 169.3, 169.4

(56) References Cited

U.S. PATENT DOCUMENTS

| | | | | |
|---|---|---|---|---|
| 4,249,105 A | | 2/1981 | Kamegaya et al. | 313/213 |
| 5,463,271 A | | 10/1995 | Geis et al. | |
| 5,666,025 A | | 9/1997 | Geis et al. | |
| 5,675,216 A | | 10/1997 | Kumar et al. | 313/495 |
| 5,709,577 A | | 1/1998 | Jin et al. | 445/24 |
| 5,744,195 A | | 4/1998 | Jin et al. | |
| 5,828,162 A | | 10/1998 | Danroc et al. | 313/309 |
| 5,900,301 A | | 5/1999 | Brandes et al. | |
| 5,939,824 A | | 8/1999 | Kishi et al. | |
| 5,977,697 A | * | 11/1999 | Jin et al. | 313/310 |
| 6,008,569 A | * | 12/1999 | Yamanobe | 313/310 |
| 6,084,338 A | * | 7/2000 | Bojkov et al. | 313/309 |
| 6,097,139 A | | 8/2000 | Tuck et al. | 313/310 |
| 6,262,701 B1 | * | 7/2001 | Okuda et al. | 345/74.1 |
| 6,400,091 B1 | * | 6/2002 | Deguchi et al. | 313/495 |

FOREIGN PATENT DOCUMENTS

| | | |
|---|---|---|
| EP | 1047096 A2 | 10/2000 |
| JP | 50-081060 | 7/1975 |
| JP | 54-051776 | 4/1979 |
| JP | 01-173555 | 7/1989 |
| JP | 06-036688 | 2/1994 |
| JP | 2000-182508 | 6/2000 |
| WO | WO 96/25753 | 8/1996 |

OTHER PUBLICATIONS

Fan et al: "Self–Oriented Regular Arrays Of Carbon Nanotubes And Their Field Emission Properties" Science, American Association for the Advancement of Science, US, vol. 283, Jan. 22, 1999, pp. 512–514.

Geis et al: "Diamond Grit–Based Field Emission Cathodes", IEEE Electron Device Letters, vol. 18, No. 12, Dec. 1997, pp. 595–598.

Garate, Eusebio et al., "*Novel Cathode for Field–Emission Applications*", Review of Scientific Instruments, American Institute of Physics, US, vol. 66, Nr. 3, 1995, pp. 2528–2532.

Republic of France Search Report dated Mar. 20, 2003.

* cited by examiner

*Primary Examiner*—Don Wong
*Assistant Examiner*—Chuc Tran
(74) *Attorney, Agent, or Firm*—Rader, Fishman & Grauer PLLC; Ronald P. Kananen

(57) ABSTRACT

The present invention is intended to efficiently concentrate an electric field and to improve electron emission efficiency in a field emission cathode constituting a flat display device. A field emission cathode constituting a flat display device is constituted to have an electron emission section arranged to face an electron applied surface. At least the electron emission section is formed out of conductive, thin plate-like fine particles. A substance having a work function of 2 to 3 eV is bonded on the surfaces of the thin plate-like fine particles.

8 Claims, 9 Drawing Sheets

FIELD EMISSION CATHODE, ELECTRON EMISSION DEVICE AND ELECTRON EMISSION DEVICE MANUFACTURING METHOD

BACKGROUND OF THE INVENTION

1. Field of the Invention

The present invention relates to a field emission cathode, an electron emission device and an electron emission device manufacturing method.

2. Description of the Related Art

Various types of flat display devices each having a field emission cathode, i.e., panel display devices, have been proposed. To realize bright picture display, a cathode-ray tube configuration for impacting an electron beam on a fluorescent screen serving as a picture formation surface to thereby emit light is normally adopted.

In a conventional flat display device having a cathode-ray tube configuration, as proposed in Japanese laid-open patent publication No. 1-173555, for example, a plurality of thermionic emission cathodes, i.e., filaments are provided to face a fluorescent screen, thermions generated from the cathodes and secondary electrons resultant from the thermions are directed toward the fluorescent screen to thereby excite and emit the fluorescent screen having colors according to a video signal using an electron beam. In this case, as a display screen becomes larger in size, a constitution in which common filaments are provided for many pixels, i.e., many red, green and blue fluorescent trios forming a fluorescent screen, is adopted.

Therefore, as the display screen becomes larger in size,it becomes complicated to arrange and assemble the filaments. Further, with a view of making a flat display device of cathode-ray tube configuration smaller in size, the depth of the device is made shorter by shortening an electron gun and increasing the deviation angle of electrons. However, since the display screen of a flat display device is increasingly made larger in size, the development of thinner, flat display devices is further desired.

In light of the above respects, a flat display device employing field emission cathodes or so-called cold cathodes has been proposed for the conventional flat display device. In case of the electron emission device having cold cathodes, the selection of a cathode material and a method of forming the cold cathodes constitute important factors in the determination of device performance. The conventional field emission cathode employs high melting point metal such as Mo, Ni and W, or Si for the material of an emitter which emits electrons.

Further, there is proposed a so-called Spindt type electron emission section constituting a flat display device having a conventional structure.

The structure of one example of a conventional flat display device 100 will be described with reference to the drawing.

FIG. 14 is a schematic perspective view of a flat display device 100 having a conventional structure.

The flat display device 100 has a fluorescent screen 101, a flat white light emission display device main body 102 having field emission cathodes K arranged to face the fluorescent screen 101, and a flat color shutter 103 arranged to contact with or face the front surface at which the fluorescent screen 101 is arranged.

As shown in FIG. 14, the display device main body 102 has a light transmission front panel 104 and a back panel 105 facing each other through a spacer (not shown) for holding the panels 104 and 105 at a predetermined distance therebetween, the peripheral portions thereof are airtight sealed by a glass frit or the like, and a flat space is formed between the panels 104 and 105.

An anode metal layer 160 and a fluorescent screen 101 having a white light emission fluorescent materral bonded on the entire surface are formed on the inner surface of the front panel 104. A metallized layer 106 such as an Al film is bonded on the resultant surface as in the case of an ordinary cathode-ray tube.

On the other hand, many cathode electrodes 107 extending perpendicularly in, for example, a band manner are arranged in parallel and bonded on the inner surface of the back panel 105.

An insulating film 108 is bonded on the cathode electrodes 107 and gate electrodes 109 extending in a direction almost orthogonal to the extension direction of the cathode electrodes 107, e.g., in a horizontal direction, are arranged in parallel.

Opening holes 110 are perforated at crossings at which the cathode electrodes 107 and the gate electrodes 109 cross one another. Conical field emission cathodes K are bonded and formed on the cathode electrodes 107 in each opening hole 110.

The field emission cathodes K are formed by using high melting point metal such as Mo, W or Cr, or Si. The cathodes K are of conical shape with a tip end thereof having a radius of curvature of several tens of nanometers and directed toward the gate electrode side.

If a positive voltage of several tens of volts is applied to the gate electrodes relative to the cathode electrodes, a electric field of, for example, about $10^6$ to $10^7$ V/cm is applied to the conical tip end portions and electrons are emitted therefrom by a tunnel effect.

The emitted electrons are allowed to impact on the fluorescent screen 101 formed on the anode electrodes facing the cathodes K at a distance of 0.2 mm to 1 mm therebetween, thereby obtaining fluorescence emission.

One pixel of the flat display device 100 consists of several tens to several thousands of Spindt-type electron emission sections. To structure a display having 1024×768×(RGB) pixels of XGA class which is the standard class of a computer display, for example, 100 million to 100 billion electron emission sections are required.

The constitution of a cathode structure including the field emission cathodes K, the gate electrodes and the like constituting the flat display device 100 having the conventional structure will be described with reference to the manufacturing step views shown in FIGS. 15 to 18, together with one example of a manufacturing method to facilitate understanding the cathode structure.

First, as already described above with reference to FIG. 14, cathode electrodes 107 are formed on the inner surface of the back panel 105 in one direction, e.g., in a perpendicular scan direction.

Each cathode electrode 107 is formed into a predetermined pattern by, for example, forming a metal layer such as a Cr layer on an entire surface by deposition, sputtering or the like and then selectively etching the metal layer by photolithography.

Next, as shown in FIG. 15, an insulating layer 108 is bonded on the entire surfaces of the cathode electrodes 107 thus patterned by sputtering or the like. Further, metal 111 such as high melting point metal of Mo or W, finally constituting gate electrodes 109, is formed on the insulating layer 108 by deposition, sputtering or the like.

Next, as shown in FIG. 16, a resist pattern (not shown) made by a photoresist or the like is formed and the metal film 111 is subjected to anisotropic etching, e.g., RIE (reactive ion etching) using the resist pattern as a mask, thereby forming band-shaped cathode electrodes 109 into a predetermined pattern, i.e., in a horizontal direction orthogonal to the extension direction of the cathode electrodes 107 shown in FIG. 14. In addition, a plurality of small holes 111*h*, for example, are formed in portions where the gate electrodes 109 cross the cathode electrodes 107.

Next, through these holes 111*h*, etching, e.g., chemical etching by which the gate electrodes 109, i.e., the metal layer 111 is not etched and the insulating layer 108 is isotropically etched, is performed to thereby form opening holes 112 each having a larger width than the width of a small hole 111*h* and having a depth corresponding to the entire thickness of the insulating layer 108.

In this way, as shown in FIG. 14, the opening holes 110 each consisting of the opening hole 112 and the small hole 111*h* are formed at crossings at which the cathode electrodes 107 and the gate electrodes 109 cross one another.

Next, as shown in FIG. 17, a metal layer 113 made of, for example, Al, Ni or the like is bonded on the gate electrodes 109 by oblique deposition.

The oblique deposition is carried out while rotating the back panel 105 within the plane thereof and round holes 114 each having a conical inner periphery are formed on surroundings above the small holes 111*h*.

In this case, the metal layer 113 is deposited while setting an angle so that the inside of the opening holes 112 is not deposited into through the small holes 111*h*.

Thereafter, a field emission cathode material, i.e., a metal having a high melting point and a low work function such as W or Mo, is bonded on the cathode electrodes 107 within the opening portions 112 perpendicularly to the cathode electrode surfaces through the round holes 114 by deposition, sputtering or the like. In this case, even if the deposition is carried out perpendicularly, the cathode material is formed to have an oblique surface continuous to the oblique surface of the metal layer 113 on the surroundings above the round holes 114. Thus, if the thickness of the deposited material reaches a certain level, the round holes 114 get closed. Due to this, dot-like, conical cathodes K each having a triangular cross section are formed in the respective opening holes 112 on the cathode electrodes 107.

Then, as shown in FIG. 18, the metal layer 113 and the cathode material formed on the metal material 113 are removed, thereby forming conical, dot-like cathodes each having a triangular cross section in the respective opening holes 110 on the band-shaped, i.e., stripe-shaped cathode electrodes 107.

The insulating layer 108 exists around the cathodes K, whereby the cathodes K are electrically isolated from the cathode electrodes 107 and a cathode structure having gate electrodes 109 in which electron beam transmission holes are formed by the above-stated small holes 111*h* and arranged to face the respective cathodes K, is formed.

In this way, the cathode structure in which the field emission cathodes K are formed on the cathode electrodes 107 and the gate electrodes 109 are formed across the upper portions of the cathodes K, is arranged to face the white fluorescent screen 101.

In the display device main body 102 constituted as stated above, a positive, high anode voltage relative to the cathodes is applied to the fluorescent screen 101, i.e., a metallized layer 106, and a voltage sufficient to allow electrons to be sequentially emitted between, for example, the cathode electrodes 107 and the gate electrodes 109 from, for example, the field emission cathodes provided at the crossings where the cathode electrodes 107 and the gate electrodes 109 cross one another, e.g., a voltage of 100V is applied to the gate electrodes 109 relative to the cathode electrodes 107 while modifying sequentially and according to display content, thereby directing electron beams from the tip end portions of the cathodes K toward the white fluorescent screen 101.

Thus, the display device main body 102 makes it possible to obtain white pictures in light emission patterns corresponding to the respective colors in a time division manner and to switch over the color shutter 103 synchronously with the time-division display to thereby fetch light corresponding to the respective colors. In other words, red, green and blue optical images are sequentially fetched, whereby color picture display is carried out as a whole.

As already stated above, in the flat display device 100 of the conventional structure shown in FIG. 14, the field emission cathodes K which face the fluorescent screen are each formed into a conical shape having a triangular cross section in the manufacturing steps described with reference to FIGS. 15 to 18 and an electric field is concentrated on the tip end portions of the conical cathodes K to thereby emit electrons.

However, due to the current development of technology, there is demand for forming the electron emission sections of the field emission cathodes K constituting the flat display device 100 of this type more economically.

Moreover, as already described above with reference to FIGS. 15 to 18, it is known that if the field emission cathodes K are formed out of a material, such as Mo or W, having a work function of 4 to 5 eV, a higher voltage needs to be applied so as to obtain necessary emission current density.

Meanwhile, it is necessary to efficiently concentrate an electric field and to efficiently emit electrons by making the electron emission sections sharper or forming the electron emission sections out of a material having a smaller work function so as to meet the recent demand of low power consumption.

To solve the above disadvantages, there is proposed, in Japanese laid-open patent publication No. 10-357928, a technique for employing conductive, plate-like fine particles for electron emission sections.

Further, as examples of using a material having a small work function for a cold cathode, Japanese laid-open patent publication Nos. 50-81060, 54-51776 and 6-36688 disclose techniques employing alkali metal and alkaline-earth metal nitrides.

The techniques proposed in the above publications are, however, applied to the cold cathode of a gas discharge tube and no consideration has been conventionally given to the application of such techniques to a field emission cathode.

SUMMARY OF THE INVENTION

The present invention has been made after the inventors of the present invention were long devoted to studies to solve the above disadvantages. It is, therefore, an object of the present invention to provide a field emission cathode, an electron emission device and an electron emission device manufacturing method capable of realizing efficient field emission by making the electron emission sections of a field emission cathode K constituting a flat display device smaller in size, making the tip end portions of the sections sharper, particularly limiting a work function to 2 to 3 eV to thereby bonding a material having a small work function on the surface of the field emission cathode K.

A field emission cathode according to the present invention is arranged to face an electron applied surface, wherein at least an electron emission section of the field emission cathode is formed out of conductive, thin-plate like fine particles; and a substance having a work function of 2 to 3 eV is bonded on surfaces of the conductive, thin plate-like fine particles.

An electron emission device according to the present invention is an electron emission device having a field emission cathode arranged to face a fluorescent screen, wherein the field emission cathode K constituting the electron emission device according to the present invention is constituted such that at least an electron emission section is formed out of conductive, thin plate-like fine particles; the field emission cathode K is constituted in a state in which a substance having a work function of 2 to 3 eV is bonded on surfaces of the conductive, thin plate-like fine particles; by applying an electric field electrons are emitted from an end face of the electron emission section consisting of the thin plate-like fine particles, of the electron emission cathode.

An electron emission device manufacturing method according to the present invention comprises the steps of: forming a photoresist pattern having small holes on a surface on which a field emission cathode constituting the electron emission device is formed, each of the small holes arranged regularly in advance and having a depth reaching the surface on which the field emission cathode is formed; preparing a coating agent from the conductive, thin plate-like fine particles, at least one of alkaline-earth metal, alkali metal, an alkaline-earth metal compound and an alkali metal compound, a dispersing agent and a solvent; coating the coating agent on the photoresist pattern and drying the photoresist pattern coated with the coating agent; removing the photoresist pattern; and conducting baking, evacuation and sealing operations at a temperature at which the alkaline-earth metal compound or the alkali metal compound is decomposed; and forming the electron emission cathode, in a state in which a substance having a work function of 2 to 3 eV is bonded on surfaces of the conductive, thin plate-like fine particles.

According to the field emission cathode of the present invention and the electron emission device including the field emission cathode of the present invention as a constituent element, the electron emission section of the field emission cathode K is formed out of thin plate-like fine particles. Due to this, if an electric field is applied to the electron emission section, the electron beam emission section is made sharper.

Further, the field emission cathode K is constituted such that an electron emission substance having a work function of 2 to 3 eV is bonded on the surfaces of the conductive, thin plate-like fine particles. Since the substance having a work function of 2 to 3 eV is bonded on the surfaces of the thin plate-like fine particles constituting the field emission cathode while the carbon constituting the field emission cathode has work function of about 4.7 eV, it is possible to particularly decrease the apparent work function of the electron emission section of the field emission cathode relative to the work function of carbon. Thus, the threshold voltage of the field emission cathode and the electron emission device decreases, to concentrate the field efficiently and to thereby improve electron emission efficiency.

According to the electron emission device manufacturing method of the present invention, the electron emission section of the field emission cathode K is formed out of thin plate-like fine particles. Due to this, if an electric field is applied to the electron emission section, the electron beam emission section can be made sharper and it is possible to efficiently concentrate the field. Besides, the field emission cathode K is constituted such that an electron emission substance having a work function of 2 to 3 eV is bonded on the surfaces of the conductive, thin plate-like fine particles. Thus, the threshold voltage of the electron emission device is decreased, to thereby make it possible to further concentrate the electric field efficiently and to improve electron emission efficiency.

DETAILED DESCRIPTION OF THE PREFERRED EMBODIMENT

A field emission cathode according to the present invention is arranged to face an electron applied surface, wherein at least an electron emission section of the field emission cathode is formed out of conductive, thin-plate like fine particles; and a substance having a work function of 2 to 3 eV is bonded on surfaces of the conductive, thin plate-like fine particles.

An electron emission device according to the present invention is an electron emission device having a field emission cathode arranged to face a fluorescent screen, wherein the field emission cathode is constituted such that at least an electron emission section is formed out of conductive, thin plate-like fine particles; the field emission cathode is constituted in a state in which a substance having a work function of 2 to 3 eV is bonded on surfaces of the conductive, thin plate-like fine particles; and by applying an electric field, electrons are emitted from an end face of the electron emission section consisting of the thin plate-like fine particles, of the electron emission cathode.

An electron emission device manufacturing method according to the present invention is characterized by comprising the steps of: forming a photoresist pattern having small holes on a surface on which a field emission cathode constituting the electron emission device is formed, each of the small holes arranged regularly in advance and having a depth reaching the surface on which the field emission cathode is formed; preparing a coating agent from the conductive, thin plate-like fine particles, at least one of alkaline-earth metal, alkali metal, an alkaline-earth metal compound and an alkali metal compound, a dispersing agent and a solvent; coating the coating agent on the photoresist pattern and drying the photoresist pattern coated with the coating agent; removing the photoresist pattern; and conducting baking, evacuation and sealing operations at a temperature at which the alkaline-earth metal compound or the alkali metal compound is decomposed and forming the electron emission cathode, in a state in which a substance having a work function of 2 to 3 [eV] is bonded on surfaces of the conductive, thin plate-like fine particles.

The structure of one example of a flat display device 20 will be described as one example in which a field emission cathode and an electron emission device according to the present invention are applied, with reference to the accompanying drawings. It is noted, however, that the present invention should not be limited to the following embodiment.

Figure 1:
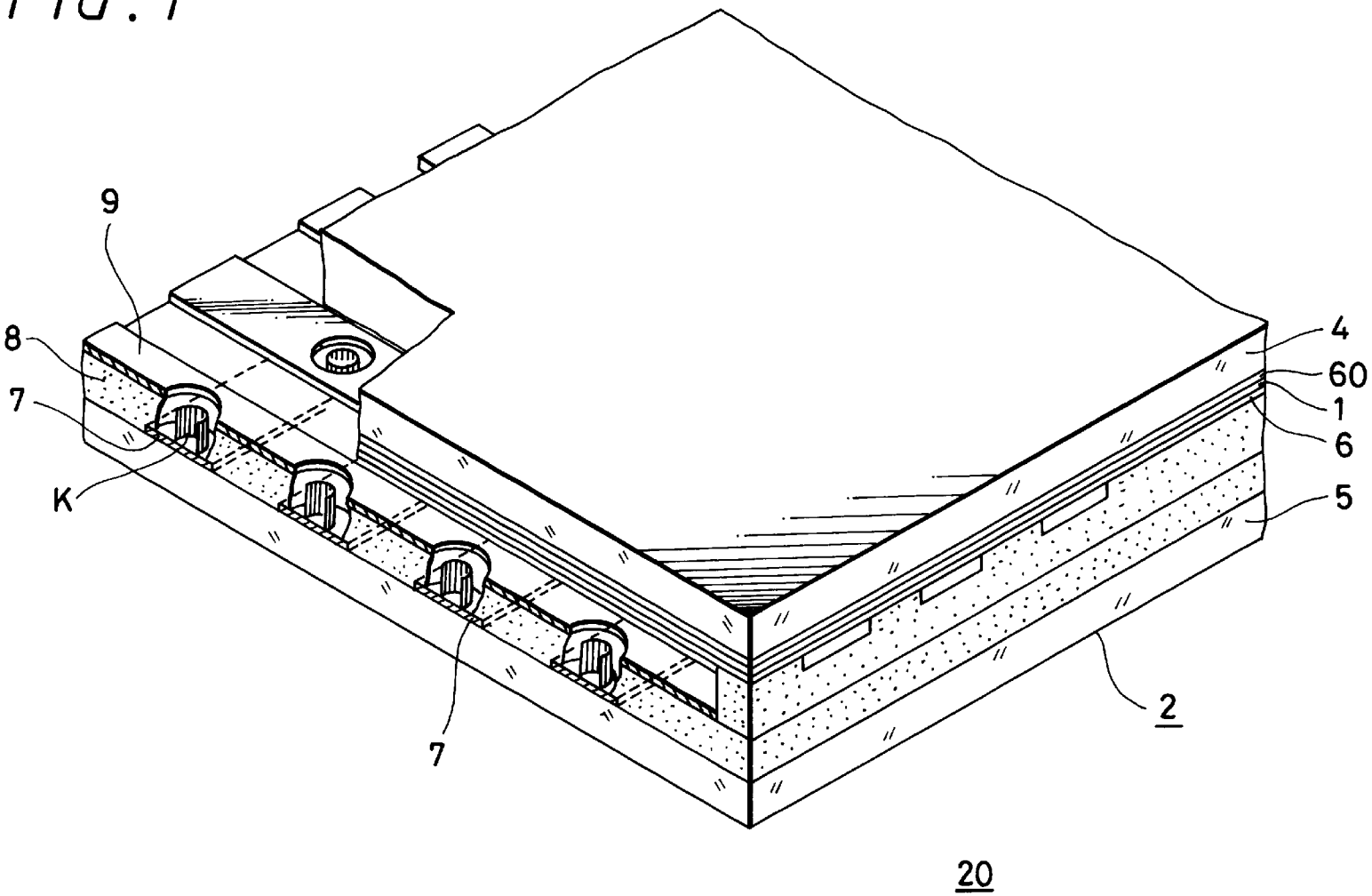
FIG. 1 is a schematic perspective view of a flat display device including field emission cathodes according to the present invention as constituent elements.

FIG. 1 is a schematic perspective view of a flat display device 20 comprising field emission cathodes and an electron emission device according to the present invention.

The flat display device 20 shown in FIG. 1 has a fluorescent screen 1, and consists of a display device main body 2 having field emission cathodes K arranged to face the fluorescent screen 1, and a flat color shutter (not shown) arranged to contact with or face the front surface of the main body 2 at a side at which the fluorescent screen 1 is arranged.

Figure 14:
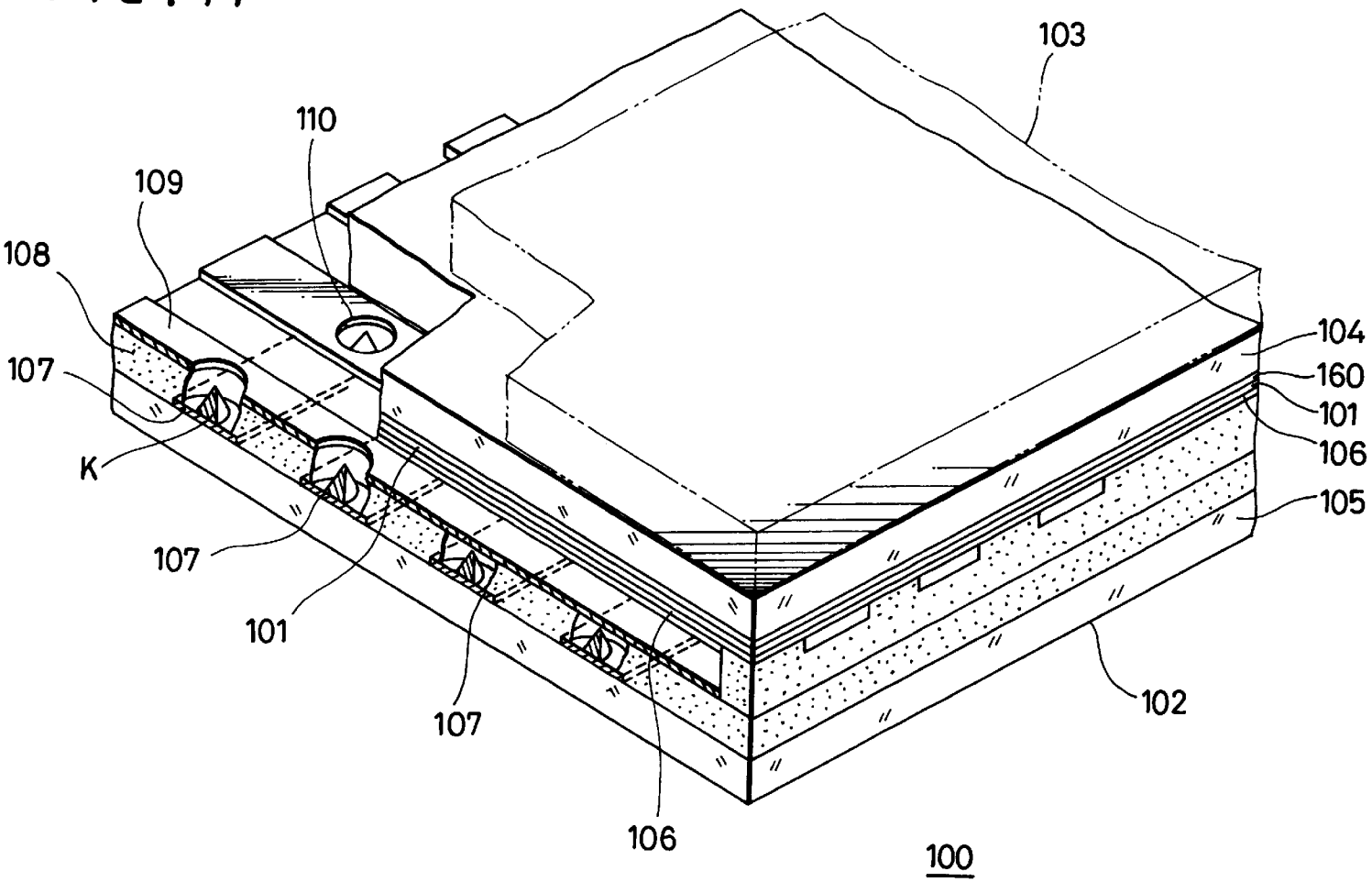
FIG. 14 is a schematic perspective view showing one example of a flat display device comprising field emission cathodes of conventional structure.
Figure 15:
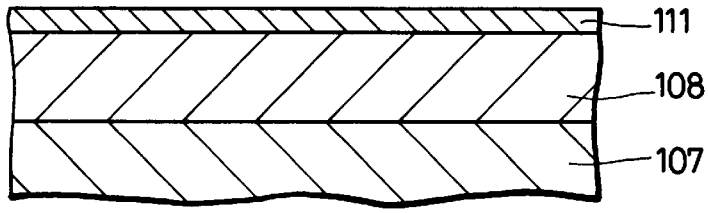
FIG. 15 is a manufacturing step view showing one example of the conventional flat display device.
Figure 16:
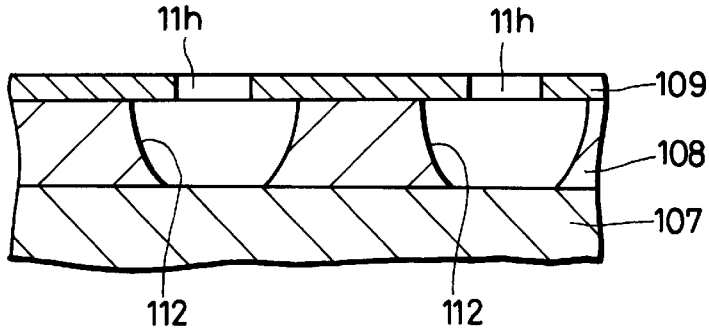
FIG. 16 is a manufacturing step view showing one example of the conventional flat display device.
Figure 17:
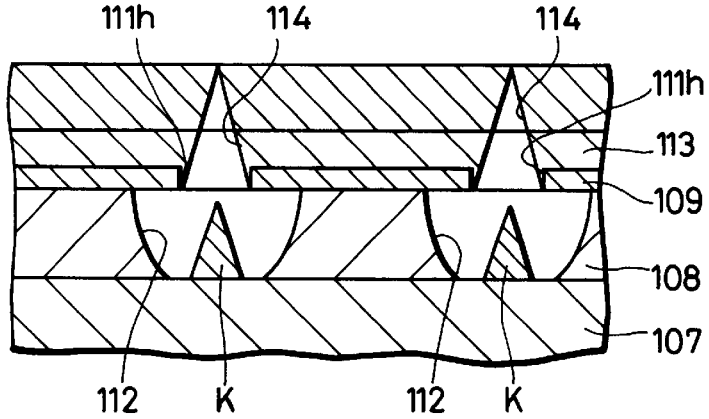
FIG. 17 is a manufacturing step view showing one example of the conventional flat display device.
Figure 18:
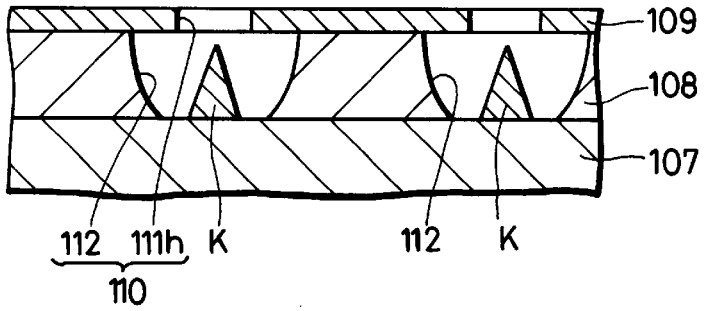
FIG. 18 is a manufacturing step view showing one example of the conventional flat display device.

In the display device main body 2, as in the case of the conventional case described with reference to FIG. 14, a light transmission front panel 4 and a back panel 5 face each other through a spacer (not shown) holding the front panel 4 and the back panel 5 at a predetermined distance therebetween, the peripheral portion of the main body 2 is airtight sealed by a glass frit or the like and a space is formed between the front panel 4 and the back panel 5.

The fluorescent screen 1 constituted by entirely bonding light emission fluorescent material in advance, is formed on the inner surface of the front panel 4. An anode metal layer 60 and a metallized layer 6 made of Al or the like are bonded on the surface of the fluorescent screen 1 as in the same manner as an ordinary cathode-ray tube.

In FIG. 1, many cathode electrodes 7 extending, for example, in a band manner are formed to be arranged in parallel on the inner surface of the back panel 5 arranged to face the front panel 4.

Gate electrodes 9 are arranged in parallel through an insulating layer 8 in a direction almost orthogonal to the extension direction of the cathode electrodes 7, e.g., in a horizontal direction.

Field emission cathodes K are formed on the respective cathode electrodes 7 and between the gate electrodes 9.

Figure 2:
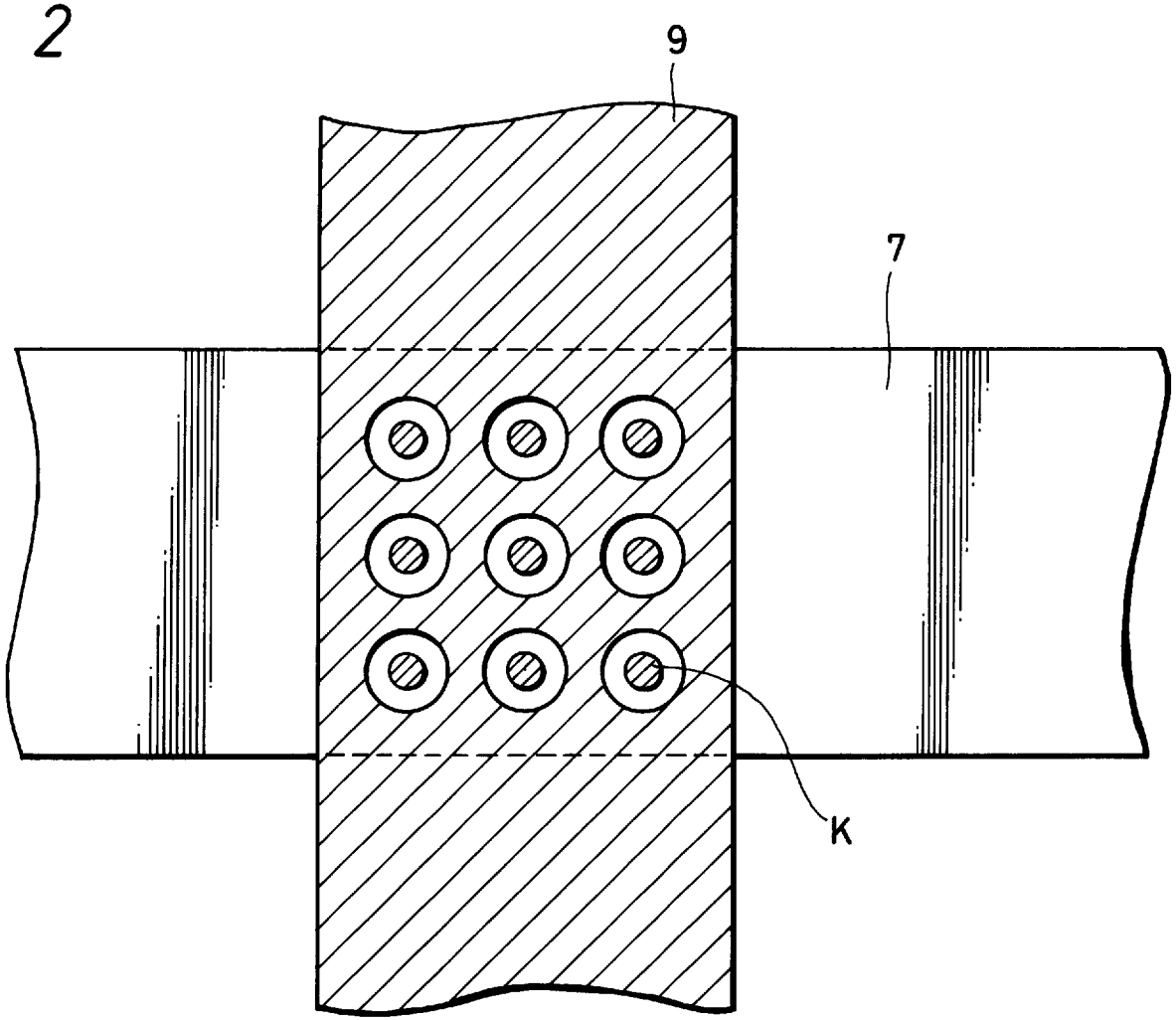
FIG. 2 is a schematic plan view showing the relative positional relationship among a cathode electrode, a gate electrode and the field emission cathodes constituting the flat display device.

FIG. 2 is a schematic view showing the relative positional relationship among the cathode electrode 7, the gate electrode 9 and the field emission cathodes K.

Although FIG. 2 illustrates a case where nine field emission cathodes K are formed on the cathode electrode 7 between the gate electrodes 9, the present invention should not be limited to the example shown in FIG. 2. The number, position of the cathodes K and the like can be appropriately changed according to the situations.

Figure 3:
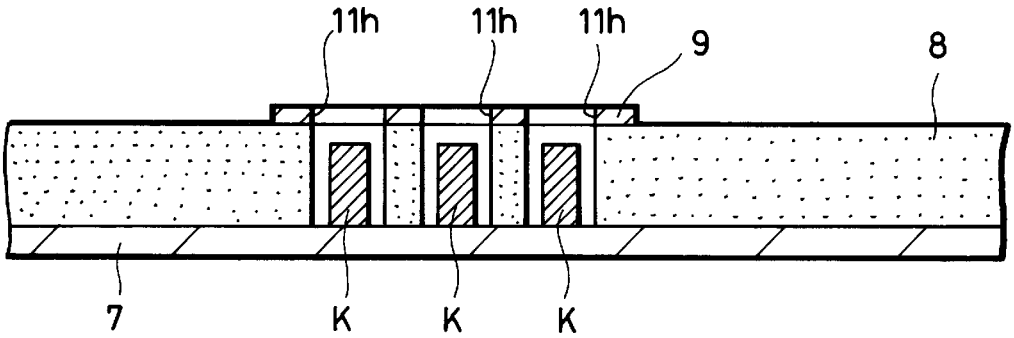
FIG. 3 is a schematic side view showing the relative positional relationship among the cathode electrode, the gate electrode and the field emission cathodes constituting the flat display device.

FIG. 3 is a schematic cross-sectional view showing the relative positional relationship among the cathode electrode 7, the gate electrode 9 and the field emission cathodes K.

Figure 4:
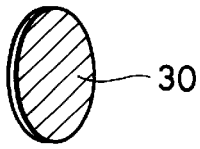
FIG. 4 is a schematic view of the thin plate-like fine particle constituting the field emission cathodes according to the present invention.

The field emission cathodes K can be formed into a shape as shown in FIG. 4, such as a circular thin plate shape or a flaky shape. The cathode K is made of a carbon combination material such as graphite, amorphous carbons or diamond-like carbons and formed by layering the thin plate-like particles 30. The thin plate-like fine particles 30 having a diameter of about 500 nm and a thickness of about 20 nm can be employed if the particles are, for example, generally circular thin plate shaped.

The thin plate-like fine particles 30 constituting the field emission cathodes K having a mean particle diameter of not more than 5 $\mu$m and a mean aspect ratio (which is a value obtained by dividing the square root of the area of the thin plate-like fine particles 30 by a thickness thereof) of not less than 5 can be employed. Preferably, 40 to 95 wt % of the thin plate-like fine particles 30 having a particle diameter of not more than 3 $\mu$m and not more than 0.1 $\mu$m are contained in the entire thin plate-like fine particles 30 constituting the field emission cathodes K, the mean particle diameter of the thin plate-like fine particles 30 constituting the field emission cathodes K is 0.05 to 0.08 $\mu$m and a mean aspect ratio (which is a value obtained by dividing the square root of the area of the thin plate-like fine particles by a thickness thereof) is not less than 10.

It is noted that the mean particle diameter of the thin plate-like fine particles 30 is a Stokes diameter and can be measured with, for example, a centrifugal sedimentation light transmission type particle size distribution measurement equipment.

If the mean particle diameter of the thin plate-like fine particles 30 is larger than 5 $\mu$m and the field emission cathode K is constituted by these particles 30, the portions of the field emission cathode K from which portion electrons are emitted cannot be sufficiently made small. To sufficiently make the electron emission sections small, it is preferable that most of the thin plate like fine particles 30 constituting the field emission cathode K have a particle diameter of not more than 0.1 $\mu$m. If the rate of the thin plate-like fine particles having a particle diameter of 0.1 $\mu$m is less than 40 wt % of all the thin plate-like fine particles 30 constituting the field emission cathode K and the field emission cathode K is formed by using a coating agent containing a solvent into which these fine particles are dispersed, then the shape of, in particular, the tip end portion of the field emission cathode K becomes disadvantageously uneven.

Judging from the above, it is preferable that the mean particle diameter of the thin plate-like fine particles 30 constituting the field emission cathode K is as small as about 0.05 to 0.08 $\mu$m.

It is assumed that the field emission cathodes K and the electron emission device comprising the field emission cathodes K according to the present invention are manufactured by articularly selecting a substance having a work function of 2 to 3 eV and bonding the selected substance on the surfaces of the thin plate-like fine particles 3 shown in FIG. 4.

It is also known that if the radius of curvature of the tip end portions, i.e., electron emission sections of the field emission cathode K is $\rho$, the electric field of the tip ends of the field emission cathode K is E and the potential of the field emission cathode K is V, then the following relational equation is satisfied:

$$E=V/(5\rho).$$

Now, consideration will be given to a case where the potential V of the tip ends of the field emission cathode K is the threshold voltage Vt at which the field emission cathode K emits electrons. The voltage of a cathode driving circuit is preferably several tens to 100 volts in view of the performance and price of a transistor.

A threshold field $E_t$ corresponding to the threshold voltage Vt depends on the material of the field emission cathode K. If cathode K is made of a metal material, the threshold field Et is not more than $10^7$ V/cm. If made of a carbon material, the threshold field Et is not more than $10^6$ V/cm.

For example, if the threshold voltage Vt is 10 V and the threshold field Et is $10^6$ V/cm, the radius of curvature is as follows based on the above equation:

$$\rho=10\ \text{V}/5\times10^6\ \text{V/cm}=0.02\ \mu\text{m}.$$

This is the order of the thin plate-like fine particles constituting the field emission cathode in the thickness direction.

Meanwhile, the magnitude of the thin plate-like fine particles 30 in the plate face direction depends on the magnitude of an emitter. The size of the emitter depends on the magnitude of the display of the flat display device.

The magnitude of the pixels of the display depends on the magnitude of the display and the density of pixels (resolution). In case of an XGA-compliant computer display of 17 to 20 inches which is a typical example of the display having a high resolution, the number of pixels is 1024×768 and the magnitude of one sub-pixel is about 60 $\mu$m×100 $\mu$m.

Several tens to several hundreds of emitters are manufactured therefrom. Therefore, the magnitude of one emitter is several tens to several micrometers. To accurately pattern the emitter having such a magnitude, it is necessary that the size of the thin plate-like fine particles 30 is sub-microns, i.e., about 0.1 to 0.5 $\mu$m. Accordingly, with=0.02 $\mu$m, the aspect ratio of the thin plate-like fine particles 30 is:

$$(0.1\ \text{to}\ 0.5)/0.02=5\ \text{to}\ 25.$$

Based on the above, the aspect ratio is preferably not less than 5, more preferably not less than 10.

If electrons are emitted based on field emission, it is known that the following Fowler Nordheim conditional equation is satisfied:

$$J=aE^2\exp(-b\phi^{1/2}\beta E).$$

In the above equation, J is an emitted electron current density, E is an electric field, $\phi$ is a work function, $\beta$ is a local field increase factor and a, b are constants.

In the above equation, $\beta$ is referred to as a form factor. If a surface is flat, $\beta$ is 1. It is known that the factor $\beta$ can be calculated from the Fowler Nordheim equation obtained by the measurement of current-voltage characteristic while the work function of a substance is measured in advance. If a surface is flat (or $\beta$=1), the work function of this substance is not more than 0.4 eV.

The work function $\phi$ is a numeric value peculiar to a substance. To decrease the apparent work function of the field emission cathode K, there are known methods of making the tip ends of the field emission cathode K sharper to concentrate the field or bonding a substance having a small work function on the surface of the substance of the field emission cathode K. Namely, it is necessary that the tip ends of the field emission cathode K are made sharper to increase the factor $\beta$ (shape factor) or a substance having a small work function is bonded to the surface of the cathode K so as to decrease the apparent work function.

If the work function $\phi$ is several electron volts, a large $\beta$, i.e., a sharp electron emission section is required accordingly.

As can be seen from the above, it is necessary to make the work function $\phi$ small so as to realize stable electron emission without excessively depending on the shape of the electron emission section.

Judging from the above, as a material having a relatively small work function, alkaline-earth metal oxides mainly consisting of barium oxides each having a work function of about 2 to 3 eV may be used to manufacture the field emission cathode K.

However, if the field emission cathodes K manufactured using the oxides mainly consisting of barium oxides, it is required to heat the cathodes up to about 800° C. to emit electrons. Besides, the material is extremely unstable in the air and tends to react with $H_2O$ or $CO_2$ in the air to be disadvantageously changed to hydroxides or carbonates. Due to this, these materials have not been used conventionally for the field emission cathodes K.

Further, materials with a relatively small work function of about 2 to 3 eV may include alkali metal and alkaline-earth metal in addition to the above-stated materials.

However, the alkali metal and alkaline-earth metal are chemically active and react with $H_2O$ or $O_2$ in the air if contacting with the air. Due to this, these materials have disadvantage, in a practical sense, in that the characteristics as the field emission cathode deteriorate.

Now, one example of the field emission cathode K and the electron emission device comprising the field emission cathodes K according to the present invention will be described with reference to manufacturing step views showing the manufacturing methods. It is to be noted, however, that the present invention should not be limited to the following example and a combination of the example with any conventionally well-known structure is possible.

First, as already described above with reference to FIG. 1, cathode electrodes 7 for flowing a current in field emission cathodes K are formed on the surface of, for example, a glass substrate constituting the back panel 5.

The cathode electrodes 7 are constituted by, for example, forming a metal layer made of, for example, Cr by deposition, sputtering or the like and then selectively etching the metal layer into a predetermined pattern by photolithography.

Figure 5:
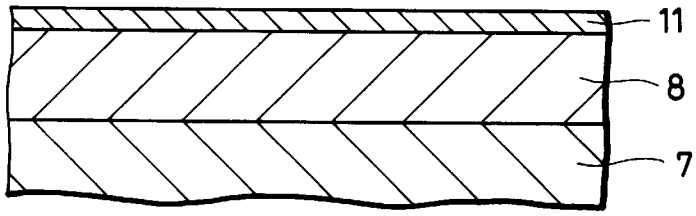
FIG. 5 is a manufacturing step view for manufacturing the field emission cathode according to the present invention.

Next, as shown in FIG. 5, an insulating layer 8 is bonded on the entire surface of the cathode electrode 7 formed into a pattern by sputtering or the like and a metal layer 1 which finally constitutes the gate electrodes 9 is formed on the insulating layer 8 by deposition, sputtering or the like using high melting point metal of Mo or W.

Figure 6:
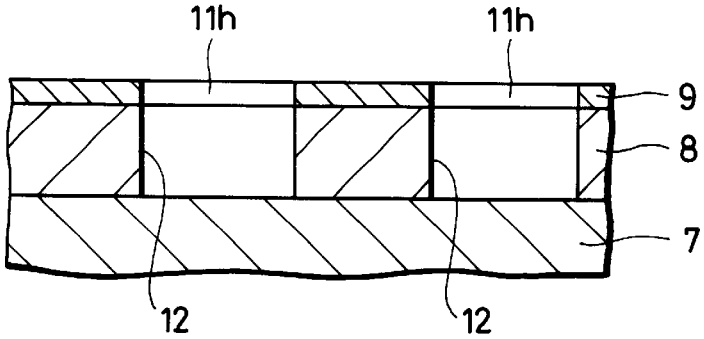
FIG. 6 is a manufacturing step view for manufacturing the field emission cathode according to the present invention.

Then, as shown in FIG. 6, a predetermined resist pattern is formed by a photoresist (not shown). Using the resist pattern as a mask, the metal layer 11 is subjected to anisotropic etching such as RIE (reactive ion etching) into a predetermined pattern, i.e., to form band-like gate electrodes 9 extending in a direction orthogonal to the extension direction of the cathode electrodes 7.

A plurality of small holes 11*h* each having a diameter of 15 μm are formed in the portions where the gate electrodes 9 and the cathode electrodes 7 cross one another.

Next, through these small holes 11, chemical etching with which the gate electrodes 9, i.e., the metal layer 11 is not etched and the insulating layer 8 is etched, is performed to thereby form opening holes 12 each having an opening width almost equal to that of each small hole 11*h* and a depth corresponding to the entire thickness of the insulating layer 8.

Figure 7:
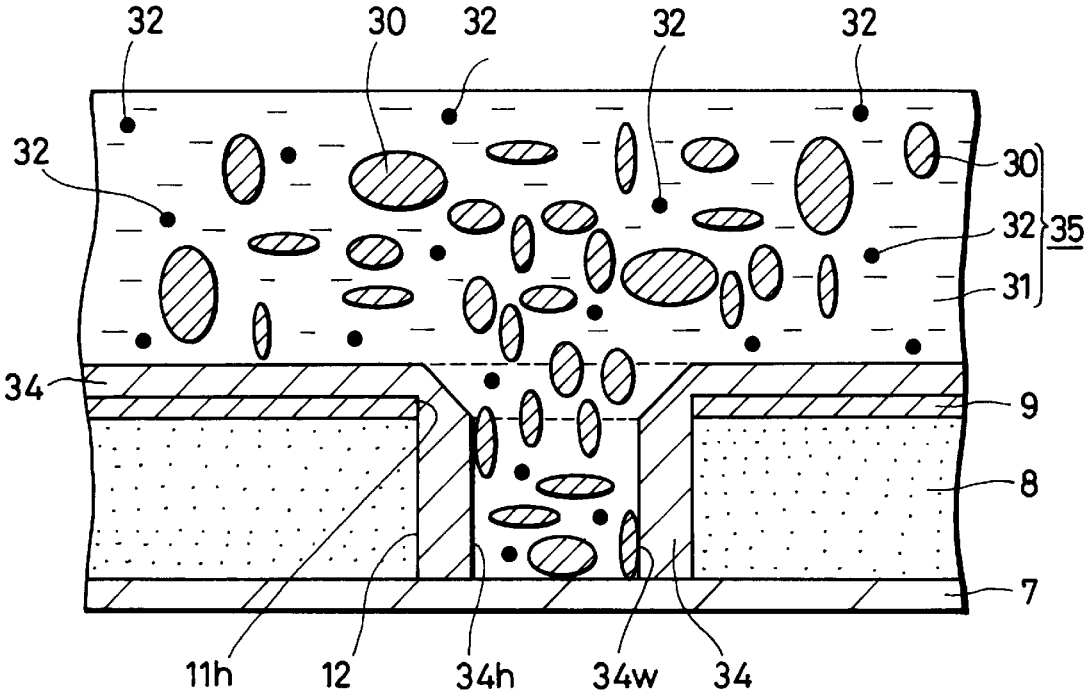
FIG. 7 is a manufacturing step view for manufacturing the field emission cathode according to the present invention.

Next, as shown in FIG. 7, after forming the small holes 11*h* and the opening holes 12, a photoresist 34 is bonded. The photoresist 34 is dried and exposed with a high pressure mercury lamp and developed with, for example, an alkali development solution, whereby photoresist holes 34*h* of, for example, 7 μm can be formed in the small holes 11*h* and the opening holes 12.

As the photoresist 34, both a negative photoresist and a positive photoresist can be used. For example, a positive photoresist of a NOVOLAC type (PMER6020EK manufactured by TOKYO OHKA KOGYO CO., LTD.) can be used.

Next, an alkali metal compound or an alkaline-earth metal compound such as barium azide or potassium azide or a mixture thereof (to be referred to simply as "a chemical substance 32" hereinafter) is dispersed into a solvent 31, e.g., appropriate organic solution or water, and further flaky fine particles, i.e., thin plate-like fine particles 30 as shown in FIG. 4 are dispersed into the solvent 31 to thereby produce a coating agent 35.

The coating agent 35 thus produced is coated on the pattern of the photoresist 34 by, for example, a spinner or a coater as shown in FIG. 7.

It is noted that the following steps may be also applied.

The first coating agent produced by dispersing flaky fine particles, i.e., thin plate-like fine particles 30 shown in FIG. 4 into a solvent and the second coating agent produced by dispersing an alkali metal compound, an alkaline-earth metal compound or a mixture thereof such as barium azide or potassium azide, i.e., the chemical substance 32 into the solvent 31 are separately prepared. First, the first coating agent is coated and the second coating agent is then coated on the surface of the coating film coated with the first coating agent.

It was confirmed that there was no difference in the quality of the product of a finally obtained field emission cathode K, between the steps in which the first coating agent produced by dispersing the thin plate-like fine particles 30 into a solvent and the second coating agent produced by dispersing the chemical substance 32 into the solvent 31 are prepared separately, the first coating agent is coated and then the second coating agent is coated on the surface coated with the first coating agent, and the steps in which the coating agent 35 produced by dispersing the thin plate-like fine particles 30 and the chemical substance 32 into the solvent 31 is prepared and a coating film is formed out of the coating agent 35.

In the above case, a thermosetting resin or the like may be added to the solvent 31 in advance so as to facilitate patterning in a later step.

Figure 8:
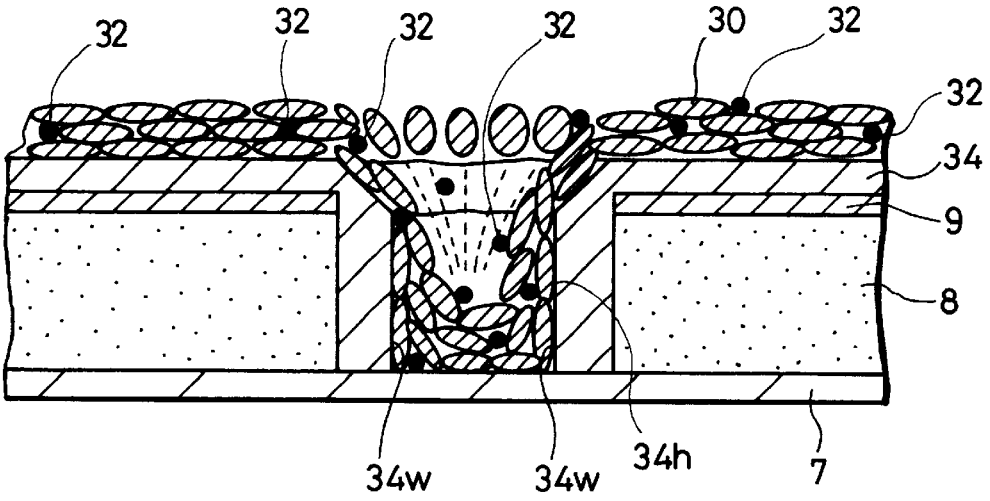
FIG. 8 is a manufacturing step view for manufacturing the field emission cathode according to the present invention.

Next, the coating film formed by coating the coating agent 35 is dried with a hot plate or the like. At this time, the thin plate-like fine particles 30 within the opening holes 34*h* of the photoresist are spontaneously oriented along wall portions 34*w*. If remaining layered, the thin plate-like fine particles 30 are arranged in a direction in which the plate direction of the thin plate-like fine particles 30 as shown in FIG. 8 mainly crosses the electron applied surface of the front panel 4 shown in FIG. 1. Namely, on the wall portions 34*w* of the photoresist, the plane direction of the thin plate fine particles 30 is almost perpendicular to that of the cathode electrodes 7.

At this moment, the thin plate-like particles 30 are layered on the photoresist in a state in which the particles of the chemical substance 32, that is, the particles of the alkali metal compound or the alkaline-earth metal compound such as barium azide or potassium azide are bonded on the surfaces of the thin plate-like particles 30.

Thereafter, a pre-baking processing is carried out at a temperature of, for example, about 150° C. or lower to form a layer of the thin plate-like fine particles 30.

Figure 9:
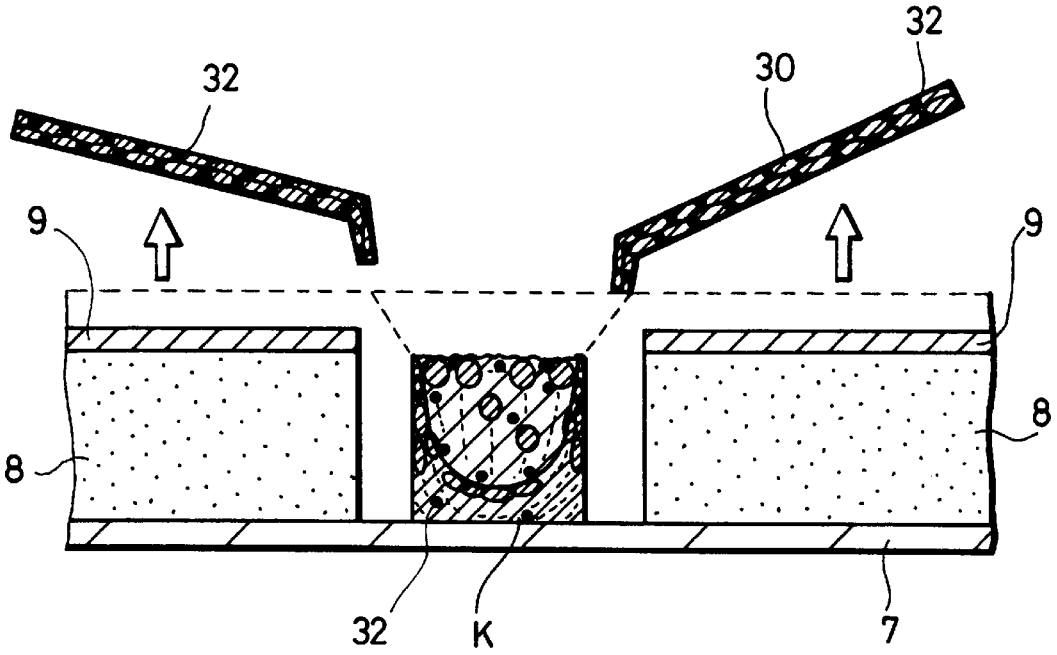
FIG. 9 is a manufacturing step view for manufacturing the field emission cathode according to the present invention.

Next, as shown in FIG. 9, the photoresist 34 as well as the thin plate-like fine particles 30 layered on the photoresist 34 is developed and removed with acid, alkali or other organic solvent chemicals. If the thin plate-like fine particles 30 are particularly made of graphite, pure water is sprayed with high pressure after the development and removal step, thereby making it possible to ensure forming the field emission cathodes K to be manufactured finally into a fine pattern.

Figure 10:
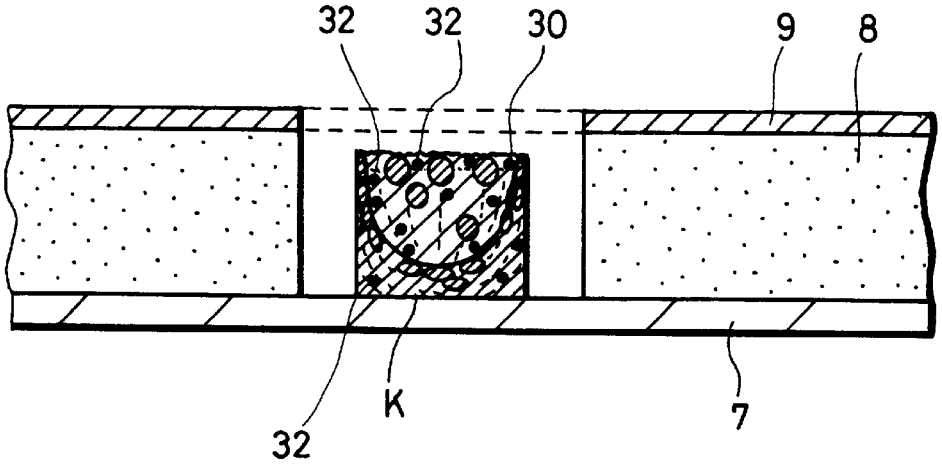
FIG. 10 is a schematic cross-sectional view showing one example of the field emission cathode according to the present invention.

Thereafter, a baking processing (post-baking) is carried out to thereby manufacture the field emission cathode K according to the present invention as shown in FIG. 10.

Then, as shown in FIG. 1, the light transmission front panel 4 and the back panel 5 on which the field emission cathodes K according to the present invention are formed, face each other through a spacer (not shown) holding the panels 4 and 5 at a predetermined distance therebetween. The peripheral portion thereof is airtight sealed by a glass frit or the like and a flat space is formed between the front panel 4 and the back panel 5.

In the step of sealing the both panels, the panels are incorporated into an exhauster, heated in a vacuum or in an inert gas atmosphere, and sealed while conducting the step of thermally decomposing the chemical substance 32 such as the alkali metal compound, the alkaline-earth metal compound such as barium azide or potassium azide.

Namely, the alkali metal compound, the alkaline-earth metal compound or the like bonded on the graphite during frit baking is thermally decomposed, and alkali metal or alkaline-earth metal having a work function of 2 to 3 eV or the non-reacted alkali metal compound or alkaline-earth metal compound is finally bonded on the surface of graphite.

Further, as the alkali metal compound or alkaline-earth metal compound employed in the above embodiment, a sodium nitride, e.g., sodium azide can be heated and decomposed as in the case of the above and alkali metal having a work function of 2 to 3 eV or, in this case, free sodium can be bonded on the surface of graphite.

In that case, it is necessary to set heating temperature at 280° C. to 400° C.

Further, as the alkali metal nitride or alkaline-earth metal nitride, a well-known nitride is applicable besides the above nitrides. For example, TiN (work function $\phi$=2.92 eV) or ZrN (work function $\phi$=2.92 eV) can be employed as well. It was confirmed that the same advantage as that in the above embodiment was obtained even if the field emission cathode K was manufactured using TiN or ZrN.

Figure 11:
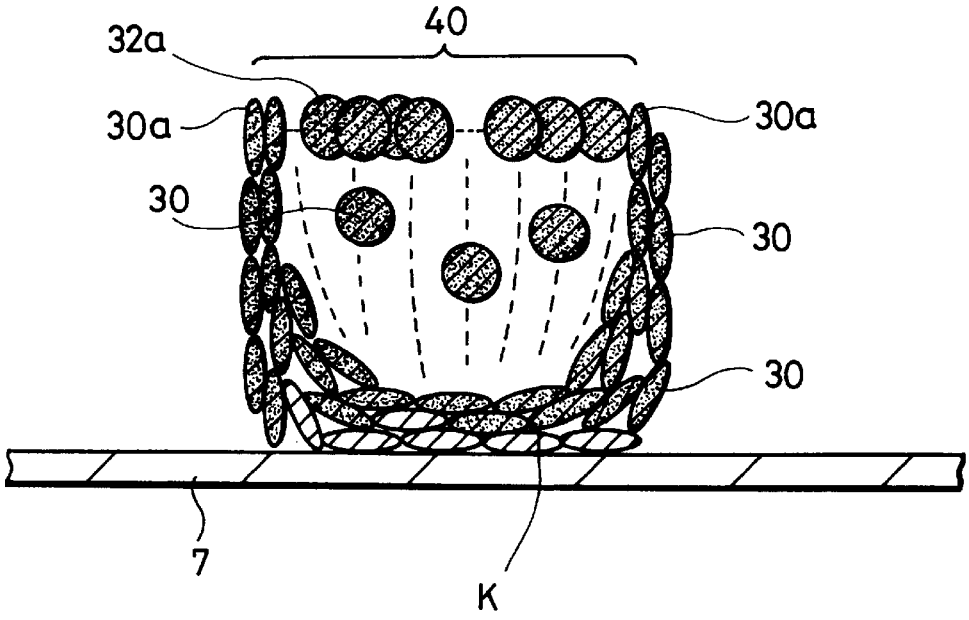
FIG. 11 is an enlarged, schematic cross-sectional view showing one example of the field emission cathode according to the present invention.
Figure 12:
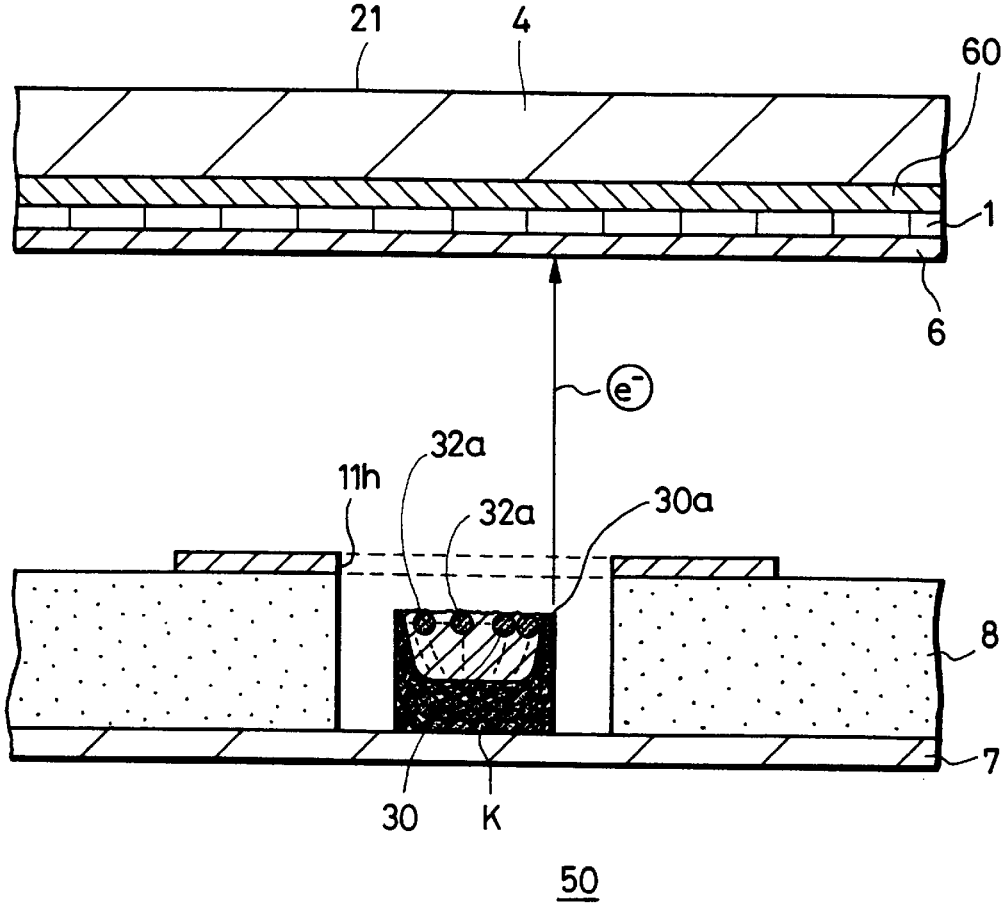
FIG. 12 is a schematic cross-sectional view of an electron emission device according to the present invention.

FIG. 11 is a schematic cross-sectional view of the field emission cathode K manufactured through the above-stated steps. FIG. 12 is a schematic cross-sectional view of the electron emission device 50 provided with the field emission cathodes K according to the present invention.

In case of the field emission cathode K shown in FIG. 11, a substance 32*a* having a work function of 2 to 3 eV, i.e., the chemical substance 32 such as alkali metal, alkaline-earth metal, or an alkali metal compound or alkaline-earth metal compound which did not react in the baking step, is bonded on the surfaces of the thin plate-like fine particles 30.

The substance 32*a* having a work function of 2 to 3 eV, i.e., alkali metal or alkaline-earth metal is also the substance 32 which did not react in the baking step. If the alkali metal compound or alkaline-earth metal compound having a work function of 2 to 3 eV is bonded on the surface of the field emission cathode K, it contributes to field concentration.

As shown in FIG. 11, the field emission cathode K is formed in a direction in which the plate surface direction of the thin plate-like fine particles 30 on the edge portions 30*a* of the electron emission section 40 crosses the picture formation surface 21 shown in FIG. 12, i.e., the electron applied surface.

Therefore, the edge portions 30a of the thin plate-like fine particles 30 on the end portions of the field emission cathode K each having a thickness of, for example, 20 nm are formed in a state in which the substance 32*a* having a work function of 2 to 3 eV is bonded on the surfaces of the edge portions 3*a*.

In case of the field emission cathode K according to the present invention, it is possible to form the tip end portions of the electron emission section far sharper than those of the field emission cathode of the conventional structure, i.e., the conical cathode K manufacturing method of which has been described with reference to FIGS. 15 to 18.

For example, if the thin plate-like fine particles 30 constituting the field emission cathodes K and having a thickness of about 20 nm are employed, the radius of curvature of each edge portion of the field emission cathode K becomes not more than 20 nm.

A cathode structure in which the field emission cathodes K are formed on the cathode electrodes 7 as stated above and the gate electrodes 9 are further formed across the upper portions of the cathodes K, is arranged to face the fluorescent screen 1, i.e., the electron applied surface.

In the electron emission device 50 having the field emission cathodes K thus formed, a high positive anode voltage relative to the cathodes is applied to the fluorescent screen 1, i.e., the anode metal layer 60, and a voltage with which electrons can be emitted from the field emission cathodes K arranged at the crossings where the cathode electrodes 7 and the gate electrodes 9 cross one another, is sequentially applied between the cathode electrodes 7 and the gate electrodes 9, for example, a voltage of 100 V is applied to the gate electrodes 9 relative to the cathode electrodes 7 while being modified sequentially and according to display content, as shown in FIG. 12. By doing so, it is possible to emit electron e- beams from the edge portions 30*a* of the electron emission sections of the field emission cathodes K and to direct the beams toward the fluorescent screen 1.

As can be seen from the above, the display device main body 2 shown in FIG. 1 makes it possible to obtain white pictures having light emission patterns corresponding to the respective colors in a time division manner, to switch over the color shutter synchronously with the time-division display and to fetch light corresponding to the respective color.

In other words, red, green and blue optical images are sequentially fetched, whereby color pictures are displayed as a whole.

As already stated above, according to the field emission cathode K of the present invention and the electron emission device 50 of the present invention having the field emission cathodes K, the edge portions 30*a* of the electron emission section of each field emission cathode K are formed to be sharper than those of the field emission cathode of conventional structure, i.e., conical field emission cathode.

According to the field emission cathode K of the present invention and the electron emission device 50 of the present invention having the field emission cathodes K, at least the electron emission section 40 of each field emission cathode K is formed out of the conductive, thin plate-like fine particles 30 and the plane direction of the thin plate-like fine particles 30 crosses the plane direction of the electron applied surface at the edge portions 30*a* of the electron emission section 40. Thus, it is possible to make the edge portions 30*a* sharper and to efficiently emit electrons.

The field emission cathode K of the present invention is particularly constituted such that the substance having a work function of 2 to 3 eV is bonded on the surface of the thin plate-like fine particles 30 constituting the field emission cathode K. It is, therefore, possible to emit electrons further efficiently and to improve the accuracy of the electron emission device having the field emission cathodes K.

Furthermore, not only the constitution in which the white fluorescent screen is provided on the image formation surface but also the constitution in which red, green and blue fluorescent materials are painted in a desired shape can be applied to the flat display device 20 shown in FIG. 1. Thus, the constitution of the flat display device can be appropriately changed.

Figure 13:
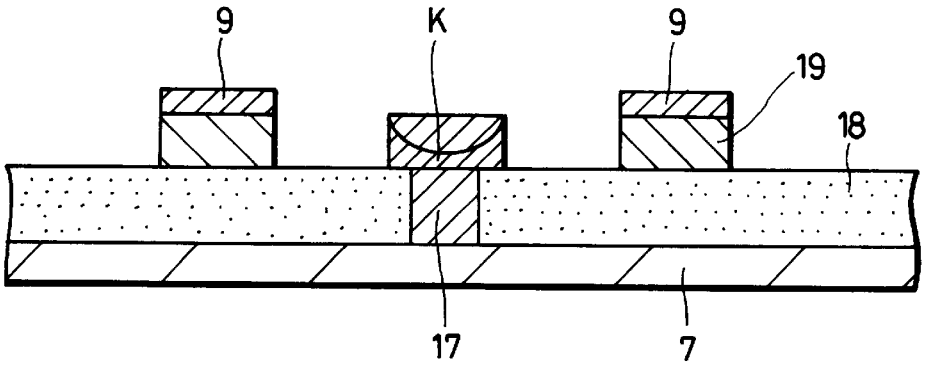
FIG. 13 is a schematic cross-sectional view showing another example of the electron emission device according to the present invention.

Moreover, in the embodiment of the flat display device stated above, description has been given to a case where the field emission cathodes K are directly formed on the cathode electrodes 7 as shown in FIG. 1. The present invention should not be limited to the constitution shown in the embodiment. As shown in, for example, FIG. 13, the present invention is also applicable to a case where an insulating layer 18 is formed on the entire surfaces of the cathode electrodes 7, the predetermined portions of the insulating layer 18 are perforated, thereby coupling the cathode electrodes 7 formed below the insulating layer 18 to the field emission cathodes K by a conductive layer 17 made of tungsten or the like so as to obtain continuity therebetween.

Additionally, in the above embodiment, description has been given to a case where barium azide or potassium azide is applied as the chemical substance having a work function of 2 to 3 eV to be bonded on the surfaces of the field emission cathodes K according to the present invention. The present invention should not be limited to the embodiment and a conventionally well-known chemical substance having a work function of 2 to 3 eV can be also applied.

Applicable chemical substances involve, for example, cesium (work function $\phi$=2.1 eV), $LaB_6$ (work function $\phi$=2.66 to 2.76 eV), $CaB_6$ (work function $\phi$=2.86 eV), $SrB_6$ (work function $\phi$=2.67 eV), $CeB_6$ (work function $\phi$=2.59 eV), $ThB_6$ (work function $\phi$=2.92 eV), BaO (work function $\phi$=2.0 to 2.7 eV), SrO (work function $\phi$=1.25 to 1.6 eV), $Y_2O_3$ (work function $\phi$=2.0 eV), CaO (work function $\phi$=1.6 to 1.86 eV), BaS (work function $\phi$=2.05 eV), TiN (work function $\phi$=2.92 eV) and ZrN (work function $\phi$=2.92 eV).

According to the field emission cathode K of the present invention and the electron emission device 50 including the field emission cathodes K of the present invention as constituent elements, the electron emission section of the field emission cathode is formed out of thin plate-like fine particles. Due to this, if an electric field is applied to the electron emission section, the electron beam emission portion is made sharper and it is possible to efficiently concentrate the electric field. Besides, the field emission cathode K of the present invention is constituted such that an electron emission substance having a work function of not more than 2 to 3 eV is bonded on the surfaces of the conductive, thin plate-like fine particles. Thus, it is possible to further concentrate the electric field efficiently and to thereby improve electron emission efficiency.

According to the electron emission device manufacturing method of the present invention, the electron emission section of the field emission cathode K is formed out of thin plate-like fine particles. Due to this, if an electric field is applied to the electron emission section, the electron beam emission portion is made sharper and it is possible to efficiently concentrate the field. Besides, the field emission cathode K of the present invention is constituted such that an electron emission substance having a work function of 2 to 3 eV is bonded on the surfaces of the conductive, thin plate-like fine particles. Thus, it is possible to manufacture the field emission cathode K capable of further concentrating the electric field efficiently and to thereby improve electron emission efficiency.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A field emission cathode arranged to face an electron applied surface, wherein an electron emission section of the field emission cathode is formed out of conductive, thin-plate like fine particles; and a substance having a work function of 2 to 3 eV is bonded on surfaces of said conductive, thin plate-like fine particles, wherein a mean particle diameter of said thin plate-like fine particles is not more than 5 $\mu$m and a mean aspect ratio (which is a value obtained by dividing a square root of an area by a thickness) is not less than 5.

2. The field emission cathode according to claim 1, wherein said substance having a work function of 2 to 3 eV consists of at least one selected from among alkaline-earth metal, alkali metal, an alkaline-earth metal compound and an alkali metal compound.

3. The field emission cathode according to claim 1, wherein said thin plate-like fine particles consist of a combination of carbons.

4. An electron emission device having a field emission cathode arranged to face a fluorescent screen, wherein said field emission cathode is constituted to have at least an electron emission section formed out of conductive, thin plate-like fine particles;

said field emission cathode is constituted in a state in which a substance having a work function of 2 to 3 eV is bonded on surfaces of said conductive, thin plate-like fine particles;

by applying an electric field, electrons are emitted from an end face of the electron emission section consisting of the thin plate-like fine particles, of said electron emission cathode, wherein a mean particle diameter of said thin plate-like fine particles is not more than 5 $\mu$m and a mean aspect ratio (which is a value obtained by dividing a square root of an area by a thickness) is not less than 5.

5. An electron emission device according to claim 4, wherein said substance having a work function of 2 to 3 eV consists of at least one selected from among alkaline-earth metal, alkali metal, an alkaline-earth metal compound and an alkali metal compound.

6. An electron emission device according to claim 4, wherein said thin plate-like fine particles consist of a combination of carbons.

7. A method of manufacturing an electron emission device having a field emission cathode formed such that a substance having a work function of not more than 2 to 3 eV is bonded on surfaces of conductive, thin plate-like fine particles, the method comprising the steps of:

forming a photoresist pattern having small holes on a surface on which field emission cathode constituting the electron emission device is formed, each of said small holes arranged regularly in advance and having a depth reaching the surface on which the field emission cathode is formed;

preparing the conductive, thin plate-like fine particles;

preparing a coating agent containing at least one of alkaline-earth metal, alkali metal, an alkaline-earth metal compound and an alkali metal compound;

coating said coating agent on said photoresist pattern and drying the photoresist pattern coated with said coating agent;

removing said photoresist pattern; and conducting baking, evacuation and sealing operations at a temperature at which said alkaline-earth metal compound or said alkali metal compound is decomposed.

8. A method of manufacturing an electron emission device according to claim 7, wherein said alkaline-earth metal compound is an alkaline-earth metal nitride; and said alkali metal compound is an alkali metal nitride.

* * * * *